United States Patent [19]

Maidment et al.

[11] Patent Number: 4,821,373

[45] Date of Patent: Apr. 18, 1989

[54] RESILIENT HINGE HAVING S-SHAPED MEMBERS AND A RELEASABLE CATCH

[75] Inventors: Robert A. M. Maidment, Suffolk; Michael T. Smith, Kent, both of England

[73] Assignee: Courier Products Limited, England

[21] Appl. No.: 94,669

[22] Filed: Sep. 9, 1987

[30] Foreign Application Priority Data

Sep. 17, 1986 [GB] United Kingdom ..... 8622324
Sep. 7, 1987 [GB] United Kingdom ..... 8721011

[51] Int. Cl.[4] ..... E05D 1/04; E05F 1/08

[52] U.S. Cl. ..... 16/227; 16/292; 16/297; 16/327; 160/231.1

[58] Field of Search ..... 16/225, 226, 227, 321, 16/327, 352, 353, 362, 363, DIG. 16.13, 292, 297; 160/135, 229.1, 231.1, 231.2, 233, 234

[56] References Cited

U.S. PATENT DOCUMENTS 344,867 7/1886 Jewett ..... 16/327
1,688,930 10/1928 Hyland ..... 16/226
3,501,800 3/1970 O'Dea ..... 16/227
3,695,330 10/1972 Hasbrouck ..... 160/231.2 X

FOREIGN PATENT DOCUMENTS 1383123 11/1964 France ..... 16/327
2115478 9/1983 United Kingdom ..... 16/227

*Primary Examiner*—Fred A. Silverberg
*Attorney, Agent, or Firm*—Kane, Dalsimer, Sullivan, Kurucz, Levy, Eisele and Richard

[57] ABSTRACT

There is described a hinged structure comprising two supports and one or more hinges hinging the supports together so that they are parallel and closely adjacent, the or each hinge comprising two hinge members, each hinge member being made of resilient strip material, each hinge member being S-shaped, passing partially round each support and together with the other hinge member forming a letter χ or FIG. 8 configuration as seen in a direction along the supports, wherein a releasable catch is provided for holding the supports in a predetermined relative angular position, the catch comprising two cam members each associated with a respective suport and the two being resiliently urged into engagement and so shaped and arranged that rotation away from the said predetermined relative angular position of the supports urges the cam members apart against the resilient urging.

8 Claims, 4 Drawing Sheets

RESILIENT HINGE HAVING S-SHAPED MEMBERS AND A RELEASABLE CATCH

This invention relates to hinges and especially to hinges for use in hanging doors.

In our British Patent Specification No: 2115478 we have described a hinged structure comprising two substantially cylindrical supports and one or more hinges hinging the supports together so that they are parallel and closely adjacent, wherein the or each hinge comprises two members each made of resiliently flexible strip material, each member being S-shaped, passing partially round each support and together with the other member forming a letter χ or FIG. 8 configuration as seen in a direction along the supports, respective means being provided fastening together the ends of the members alongside each support so that the members are tensioned round the supports. The present invention relates to improvements in the arrangements described in our aforesaid Specification.

Thus, the present invention provides a hinged structure comprising two supports and one or more hinges hinging the supports together so that they are parallel and closely adjacent, the or each hinge comprising two hinge members, each hinge member being made of resilient strip material, each hinge member being S-shaped, passing partially round each support and together with the other hinge member forming a letter χ or FIG. 8 configuration as seen in a direction along the supports, wherein a releasable catch is provided for holding the supports in a predetermined relative angular position, the catch comprising two cam members each associated with a respective support and the two being resiliently urged into engagement and so shaped and arranged that rotation away from the said predetermined relative angular position of the supports urges the cam members apart against the resilient urging.

The arrangement according to the invention has particular application to the case where the hinge structure has a self-return feature, that is to say, the supports may be angularly displaced from, and automatically returned to, a given relative position (that position being, preferably, the same as the aforesaid predetermined position). The structure according to the invention is not, however, limited in application to self-returning hinge structures but also has application to the case where the supports may be freely brought into, and then self-maintained in, a given angular position relative to each other. In this case, the aforesaid predetermined position may be used more securely to hold the support, for example, in a closed or any desired open position.

The hinge structure according to the invention has special application, however, to use with swing doors. In that case, the aforesaid predetermined position would be used to hold the door in its closed or rest position against extraneous forces such as wind or draught.

In order to provide a positive catch action it is preferred if the rate of compression of the resilient means under rotation of the supports does not tend to zero as the supports approach the predetermined position.

In order to provide a simple construction having a positive catch actionit is of advantage if the cam members have mating surface portions that seat one onto another at the predetermined angular position.

Preferably, the mating surface portions are flats.

Although it would be possible to arrange for each cam member to have its own resilient means urging it outwards and into engagement with the other cam member, it is of advantage in order to simplify the construction and reduce its cost if one cam member is fixed relative to its respective support and the other is slidably mounted relative to its support and urged outwards by the resilient means. The resilient means is preferably a spring, or combination of springs, and in a preferred embodiment the slidably-mounted cam member is acted upon by a spring wound round a spindle attached to the cam member, the end of the spindle remote from the cam member itself being cammed and acted upon by springs mounted in bores formed in the support at right angles to the spindle.

Although each cam member may be formed separately from the supports the said one cam member may be integrally formed with its respective support.

The said resilient means may be used to provide a self-returning effect. Thus, if each cam member has a mating surface portion flanked by progressively curved portions then the hinge structure will not only have a self-locking action, given by the flats, but also a self-closing action, given by the progressive curves. A self-return effect may also be obtained if at least one hinge member is pre-shaped from sprung material into an "S" form before mounting on the supports. Either or both effects may be incorporated in the hinge structure.

The or each support may constitute a curved edge portion of a door or door frame, that curved edge portion being formed either separately or integrally with the door or frame. Thus, for example, the curved edge portion could be formed by bevelling the existing edges of a door or door frame. Alternatively a curved support element, formed separately from the door or door frame could be affixed to each of those members.

The present invention also provides a hinged structure comprising two supports and one or more hinges hinging the supports together so that they are parallel and closely adjacent, wherein the or each hinge comprises two hinge members each made of resiliently flexible strip material, each hinge member being S-shaped, passing partially round each support and together with the other hinge member forming a letter χ or FIG. 8 configuration as seen in a direction along the supports, respective tensioning means being provided fastening together the ends of the hinge members so that those members are tensioned round the supports, wherein each support is of crescent-like form in cross-section, the tensioning means being arranged within the recessed part of the support.

Advantageously the fastening means comprises a screw which passes through the ends of the hinge members, or plates secured to those members, and into the back wall of the recessed portion of the support.

The present invention further provides a hinge structure comprising two supports and a plurality of hinges hinging the supports together so that they are parallel and closely adjacent, wherein each hinge comprises two members each made of resiliently flexible strip material, each hinge member being S-shaped, passing partially round each support and together with the other hinge member forming a letter χ or FIG. 8 configuration as seen in a direction along the supports, respective tensioning means being provided fastening together the ends of the hinge members alongside each support so that the hinge members are tensioned round the supports, wherein at least one of the hinges serves primarily to resist radial movement of the supports away from each other, a second hinge serves primarily to resist relative displacement of the supports in a longitudinal direction and a third hinge member serves primarily to provide a self-returning function for the hinge structure.

Preferably, the second or shear hinge is arranged below the first or tension hinge and the third or self-closing hinge.

Hinge structures constructed in accordance with the present invention will now be described, by way of example, with reference to the accompanying drawings, in which:

FIGS. 1(*a*) and 1(*b*) are diagrammatic cross-sections of a hinge structure illustrating two positions of a self-locking/self-closing mechanism;

FIGS. 2(*a*) and 2(*b*) are diagrammatic longitudinal sections of the hinge of FIGS. 1(*a*) and 1(*b*), looking in the directions of the arrows "A" and "B" respectively;

Figure 1A:
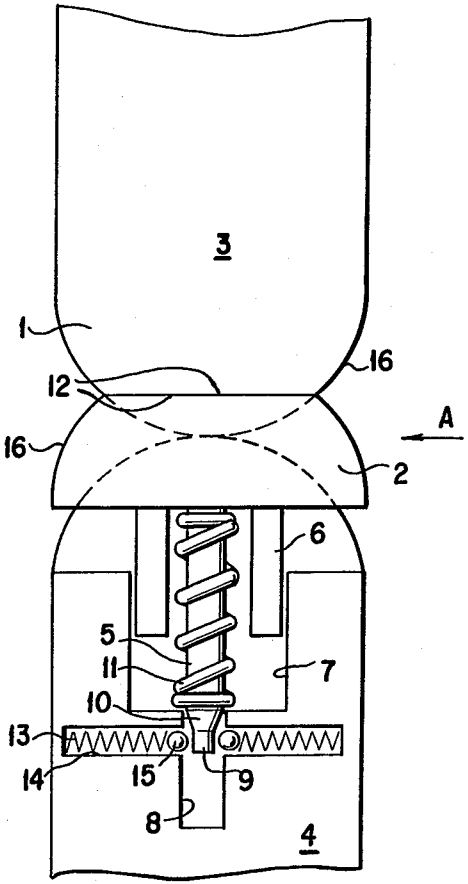
Figure 1B:
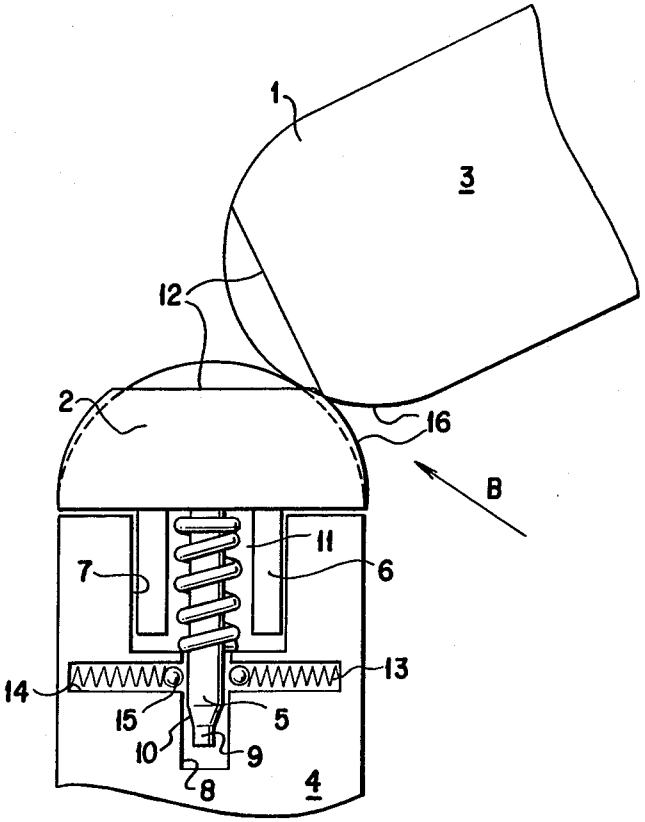
Figure 2B:
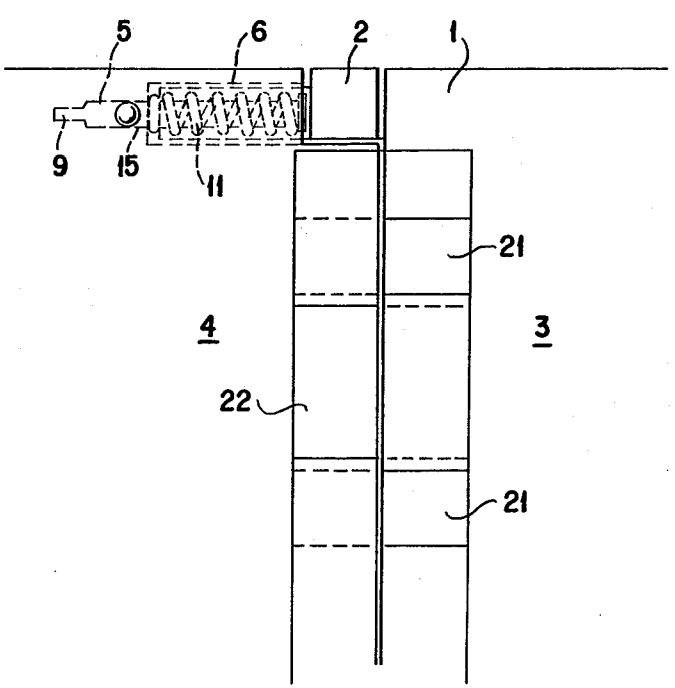
Figure 2A:
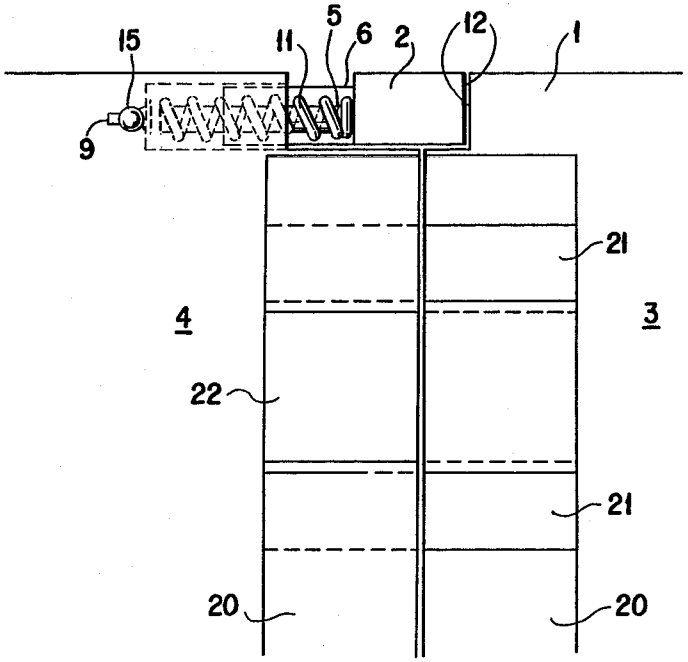

Referring to the accompanying drawings FIGS. 1 and 2 illustrate part of a hinged structure (described in more detail, with reference to FIGS. 3 and 4) comprising a self-locking/self-closing mechanism.

FIGS. 1 and 2 show a self-locking/self-closing mechanism situated at the top of a swing door. The mechanism comprises two cam members 1 and 2, the cam member 1 being fixed relative to a door or door frame 3 and the other cam member 2 being slidably mounted relative to a door frame or door 4. The cam member 2 has a central spindle 5 surrounded by an annular sleeve 6 which is located and slides in a bore 7 formed in the door frame or door 4.

An extension 8 of the bore 7 receives a reduced diameter portion 9 of the spindle 5, the reduced diameter portion 9 joins the main portion of spindle 5 through a sloping cam portion 10. The cam member 2 is, as illustrated, spring biased outwards by a spring 11 so that flats 12 on each of the cam members are held in engagement. Secondary springs 13 are located in bores 14 formed at right angles to bore 8, and carry roller or ball bearings 15 which act on the end of spindle 5 remote from cam member 2. Springs 13 are preferably stronger than springs 11. The flats 12, when in engagement, serve to retain the angular position of the door and door frame as shown in FIGS. 1(*a*) and 2(*a*).

As the door and door frame are rotated relative to each other towards an open position, shown in FIGS. 1(*b*) and 2(*b*), the two flats 12 are urged apart against the resilience of the springs 11 and 13. The springs 11 and 13 are compressed during that movement, which is only over a relatively small angular displacement (the angular displacement is exaggerated in FIGS. 1 and 2 more clearly to illustrate the principle of operation), the bearings 15 riding up the cam portion 10 to contact the main portion of spindle 5, and resist that angular displacement.

When the cam members reach the relative angular position shown in FIGS. 1(*b*) and 2(*b*) the curved portion 16 of the cam members come into rolling contact. Less effort is then required to swing open the door but when released the combined effect of the spring and the engaged curved portions returns the door to its position shown in FIGS. 1(*a*) and 2(*a*).

It will be evident, therefore, that the flats 12 provide a self-locking action whereas the progressively curved portions 16 on either side of the plates of each cam member provide a self-closing function.

Figure 3:
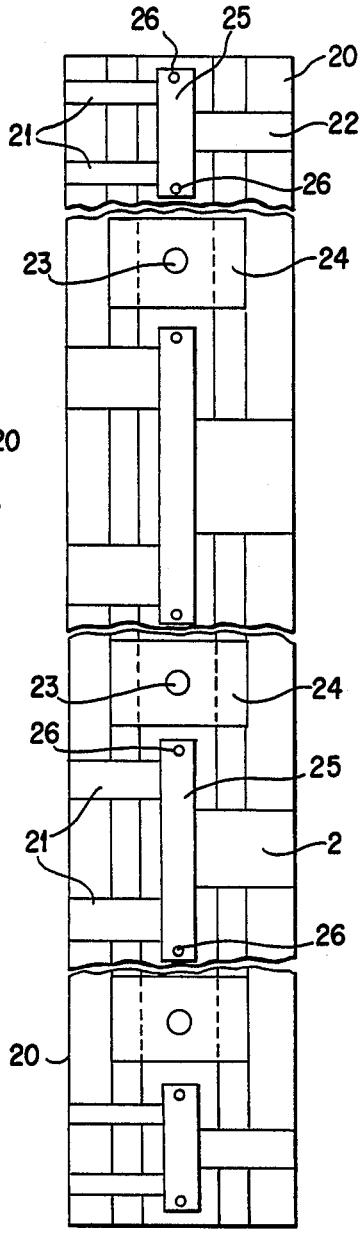
FIG. 3 is a diagrammatic rear view of a support element of a hinge structure.
Figure 4:
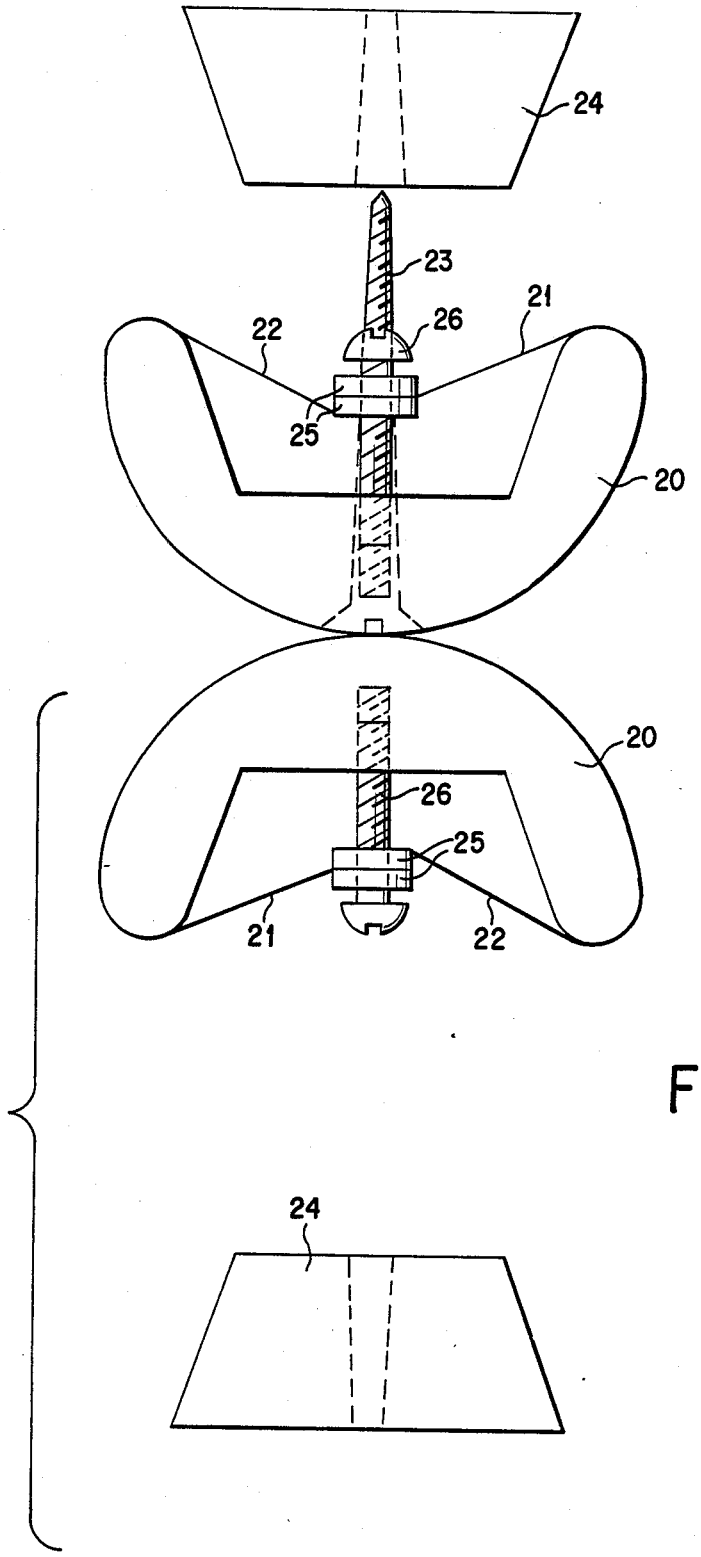
FIG. 4 is a cross-section of the support element shown in FIG. 3 hinged to a support element of similar construction.

Referring now to FIGS. 3 and 4, which illustrate a hinge structure which can incorporate the catch mechanism illustrated in FIGS. 1 and 2, the hinge structure comprises, essentially, two support elements 20 (FIG. 4) each of which is crescent-like form in cross-section. The two support elements are hinged together by a plurality of hinges. Each hinge comprises at least two hinge members 21,22, each hinge member being made of resilient strip material, being S-shaped and passing partially round each support element, and, together with the other hinge member, forming a letter $\chi$ or FIG. 8 configuration as seen in a direction along the supports.

Each support element 20 is mounted in an edge of a door or door frame (not shown). For that purpose screws 23 are passed through fixing spacers 24 provided in the support elements, the screws being passed through the spacer from outside the support element.

The ends of the hinge members 21,22 are secured together by plates 25 (see FIG. 4) welded to their ends and a screw 26 which passes through holes in the plates and then into a hole in the rearside of the support element.

Figure 5:
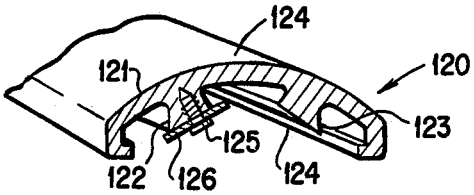
FIG. 5 is a cross-sectional view of an alternative construction of support element.

An alternative form of support element is shown, at 120, in FIG. 5. This may be a simple extrusion, having a crescent-shaped surface 121 and longitudinal internal ribs 122,123. The hinge member 124, of resilient strip material, is attached to rib 122 by a screw 125 passing through a plate 126 into the rib. It will be appreciated that the adjacent hinge member (not shown) will pass over the surface 121 in the opposite direction, and will be attached to rib 123 in similar plate-and-screw fashion.

As shown in FIG. 3 a number of hinges may be mounted on each pair of support elements. It is preferred if, as illustrated, the upper hinges are tension hinges which serve to prevent movement of the support elements radially apart, the bottom hinges are shear hinges preventing relative longitudinal displacement of the support elements and the intermediate hinge elements on the support elements provide a self-closing function.

The catch mechanism shown in FIGS. 1 and 2 is not shown in FIGS. 3 and 4 but it will be appreciated that it may be arranged anywhere along the length of the support elements and between two neighbouring hinges. Alternatively, the catch mechanism may be arranged above the uppermost hinge or, as is preferred, below the lowermost hinge.

The catch mechanism is not, of course, limited in application to the particular type of hinge structure shown in FIGS. 3 and 4 and can be used with any of the hinge structures described and illustrated in British Patent Specification No: 2115478 to which attention is directed for full details. Attention is also directed to that Specification for a fuller description of the hinges and hinge members which are used in the construction shown in FIGS. 3 and 4 of the accompanying drawings or which could be used in that construction.

We claim:

1. A hinged structure comprising two supports and at least one hinge hinging the supports together so that they are parallel and closely adjacent, each said at least one hinge comprising two hinge members, each hinge member being made of resilient strip material, each said hinge member being S-shaped, passing partially round each support and together with the other hinge member forming a letter χ configuration as seen in direction along the supports, wherein a releasable catch is provided for holding the supports in a predetermined relative angular position, the catch comprising two cam members, each associated with a respective support and the two being resiliently urged into engagement and so shaped and arranged that rotation away from the said predetermined relative angular position of the supports urges the cam members apart against the resilient urging, the cam members having mating surface portions that seat one on to another at the predetermined angular position, said mating surface portions are flats, and one cam member is fixed relative to its respective support and the other cam member is slidably mounted relative to its support and urged outwards by resilient means, wherein the resilient means is a spring wound round a spindle attached to the cam member, the end of the spindle remote from the other cam member itself being cammed and acted upon by springs mounted in bores formed in the support at right angles to the spindle.

2. A hinged structure according to claim 1 wherein each cam member has a mating surface portion flanked by progressively curved portions.

3. A hinged structure according to claim 1 wherein at least one hinged member is pre-shaped from sprung material into an "S" form.

4. A hinged structure according to claim 1 wherein each support constitutes a curved edge portion of a door or door frame.

5. A hinged structure comprising two supports and at least one hinge hinging the supports together so that they are parallel and closely adjacent, each said at least one hinge comprising two hinge members, each hinge member being made of resilient strip material, each said hinge member being S-shaped, passing partially round each support and together with the other hinge member forming a FIG. 8 configuration as seen in a direction along the supports, wherein a releasable catch is provided for holding the supports in a predetermined relative angular position, the catch comprising two cam members, each associated with a respective support and the two being resiliently urged into engagement and so shaped and arranged that rotation away from the said predetermined relative angular position of the supports urges the cam members apart against the resilient urging, the cam members having mating surface portions that seat one on to another at the predetermined angular position, said mating surface portions are flats, and one cam member is fixed relative to its respective support and the other cam member being slidably mounted relative to its support and being urged outwards by a spring wound round a spindle attached to the other cam member, the end of the spindle remote from the cam member itself being cammed and acted upon by springs mounted in bores formed in the support at right angles to the spindle.

6. A hinged structure according to claim 5 wherein each member has a mating surface portion flanked by progressively curved portions.

7. A hinged structure according to claim 5 wherein at least one hinged member is pre-shaped from sprung material into an "S" form.

8. A hinged structure according to claim 5 wherein each support constitutes a curved edge portion of a door or door frame.

* * * * *